US008863750B2

(12) United States Patent
Boll et al.

(10) Patent No.: US 8,863,750 B2
(45) Date of Patent: Oct. 21, 2014

(54) FILTER CIGARILLO

(75) Inventors: Lars Boll, St-Livres (CH); Eric De Borst, Yverdon-les-Bains (CH)

(73) Assignee: Philip Morris USA Inc., Richmond, VA (US)

( * ) Notice: Subject to any disclaimer, the term of this patent is extended or adjusted under 35 U.S.C. 154(b) by 617 days.

(21) Appl. No.: 12/644,573

(22) Filed: Dec. 22, 2009

(65) Prior Publication Data

US 2010/0154808 A1 Jun. 24, 2010

(30) Foreign Application Priority Data

Dec. 24, 2008 (EP) ..... 08254144

(51) Int. Cl.

| | |
|---|---|
| ***A24C 5/08*** | (2006.01) |
| ***A24D 1/00*** | (2006.01) |
| ***A24D 1/02*** | (2006.01) |
| ***A24D 1/04*** | (2006.01) |

(52) U.S. Cl.

CPC .. *A24D 1/02* (2013.01); *A24D 1/00* (2013.01); *A24D 1/045* (2013.01)

USPC ..... 131/58; 131/365; 131/374; 131/358; 131/297; 131/360

(58) Field of Classification Search

None

See application file for complete search history.

(56) References Cited

U.S. PATENT DOCUMENTS

| | | | | | |
|---|---|---|---|---|---|
| 2,167,170 | A | * | 7/1939 | Burns | 131/331 |
| 3,653,390 | A | * | 4/1972 | Louden | 131/361 |
| 4,365,641 | A | * | 12/1982 | Johnson | 131/336 |
| 4,984,589 | A | * | 1/1991 | Riedesser | 131/365 |
| 5,095,922 | A | * | 3/1992 | Johnson et al. | 131/296 |
| 5,172,708 | A | * | 12/1992 | Drewett et al. | 131/365 |
| 5,462,073 | A | * | 10/1995 | Bowen et al. | 131/374 |
| 5,699,812 | A | | 12/1997 | Bowen | |

FOREIGN PATENT DOCUMENTS

| | | | |
|---|---|---|---|
| FR | 2269876 | A * | 1/1976 |
| GB | 2170986 | A | 8/1986 |
| WO | WO 2007/085967 | A | 8/2007 |
| WO | WO 2007085967 | A2 * | 8/2007 |

OTHER PUBLICATIONS

International Search Report and Written Opinion mailed Apr. 26, 2010 for PCT/IB2009/007958.

International Preliminary Report on Patentability dated Jul. 7, 2011 for PCT/IB2009/007958.

International Search Report dated Jun. 9, 2009 for European Patent Application No. 08254144.2-2313.

* cited by examiner

*Primary Examiner* — Richard Crispino

*Assistant Examiner* — Phu Nguyen

(74) *Attorney, Agent, or Firm* — Buchanan Ingersoll & Rooney PC

(57) ABSTRACT

A cigarillo includes a tobacco rod including a tobacco cut filler circumscribed by an inner binder, a filter adjacent to the tobacco rod, a band of tipping paper circumscribing the filter, and an outer wrapper of natural tobacco circumscribing the tobacco rod and a rod end portion of the band of tipping paper such that a mouth end portion of the band of tipping paper is visible. A method of making the cigarillo includes convoluting an inner binder around a tobacco cut filler to form a tobacco rod, axially aligning and abutting a filter with the tobacco rod, convoluting a band of tipping paper around the filter, and convoluting an outer wrapper of natural tobacco around the tobacco rod and a rod end portion of the band of tipping paper such that a mouth end portion of the tipping paper is visible.

10 Claims, 1 Drawing Sheet

FILTER CIGARILLO

CROSS REFERENCE TO RELATED APPLICATION

This application claims priority to European Application No. 08254144.2, filed Dec. 24, 2008, the entire content of which is incorporated herein by this reference thereto.

BACKGROUND

According to the EU Council Directive 95/59/EC of Nov. 27, 1995 there are four different types of smoking articles that are considered to be cigars or cigarillos: 1) rolls of tobacco made entirely of natural tobacco; 2) rolls of tobacco with an outer wrapper of natural tobacco; 3) rolls of tobacco with an outer wrapper of the normal color of a cigar, and a binder, of reconstituted tobacco, where the wrapper is fitted in spiral form with a predetermined angle; and 4) rolls of tobacco with an outer wrapper, of the normal color of a cigar, of reconstituted tobacco, with a relatively large unit weight, and with a relatively large circumference.

Natural tobacco is relatively expensive compared to reconstituted tobacco. In addition, the handling of natural tobacco requires more care and labor than the handling of reconstituted tobacco. In particular, in cigarillos made with a reconstituted tobacco outer wrapper, the bunch that is subsequently overwrapped with the reconstituted tobacco material may be manufactured on standard, high-speed machinery employed in the production of cigarettes with little or no changes. Therefore, the cost of manufacturing cigars and cigarillos of the first and second types is generally much greater than the cost of manufacturing cigarillos of the third and fourth types.

However, natural tobacco is considered to be of higher quality and better taste than reconstituted tobacco. Therefore, it would be desirable to provide a filter cigarillo of the second type that has a lower production cost.

The present invention is directed to a cigarillo including a filter.

SUMMARY OF SELECTED ASPECTS OF THE INVENTION

In a preferred embodiment, a cigarillo includes a tobacco rod, a filter adjacent to the tobacco rod, a band of tipping paper circumscribing the filter, and an outer wrapper of natural tobacco circumscribing the tobacco rod and a rod end portion of the band of tipping paper such that a mouth end portion of the band of tipping paper is visible.

In the preferred embodiment, the length of the mouth end portion of the band of tipping paper that is visible is greater than the length of the rod end portion of the band of tipping paper. Also preferably, the band of tipping paper circumscribes the filter and an adjacent portion of the tobacco rod. The portion of the tobacco rod circumscribed by the band of tipping paper ranges from about 2 mm to about 12 mm in length. Preferably, the rod end portion of the band of tipping paper circumscribed by the outer wrapper is at least about 2 mm in length. In the preferred embodiment, the visible mouth end portion of the band of tipping paper is at least about 15 mm in length.

Also in the preferred embodiment, the tobacco rod includes a tobacco cut filler circumscribed by an inner binder. The tobacco cut filler is cut with a cut width ranging from about 0.4 mm to about 2.0 mm. Preferably, the tobacco cut filler has a moisture content of about 12.5%. Also preferably, the inner binder includes paper. The inner binder can also include homogenized tobacco material.

In the preferred embodiment, the cigarillo has a total burn rate of about 0 percent to about 15 percent.

Preferably, the outer wrapper has a longitudinal seam substantially parallel to the longitudinal axis of the cigarillo, and the outer wrapper is wrapped helically around the tobacco rod and the rod end portion of the band of tipping paper.

In the preferred embodiment, the cigarillo has a length ranging from about 70 mm to about 100 mm and a diameter ranging from about 7.5 mm to about 8.5 mm.

A method of making the cigarillo includes convoluting an inner binder around a tobacco cut filler to form a tobacco rod, axially aligning and abutting a filter with the tobacco rod, convoluting a band of tipping paper around the filter, and convoluting an outer wrapper of natural tobacco around the tobacco rod and a rod end portion of the band of tipping paper such that a mouth end portion of the tipping paper is visible.

BRIEF DESCRIPTION OF THE DRAWINGS

The invention will now be further described, by way of example only, with reference to the accompanying drawings.

DETAILED DESCRIPTION

Figure 1:
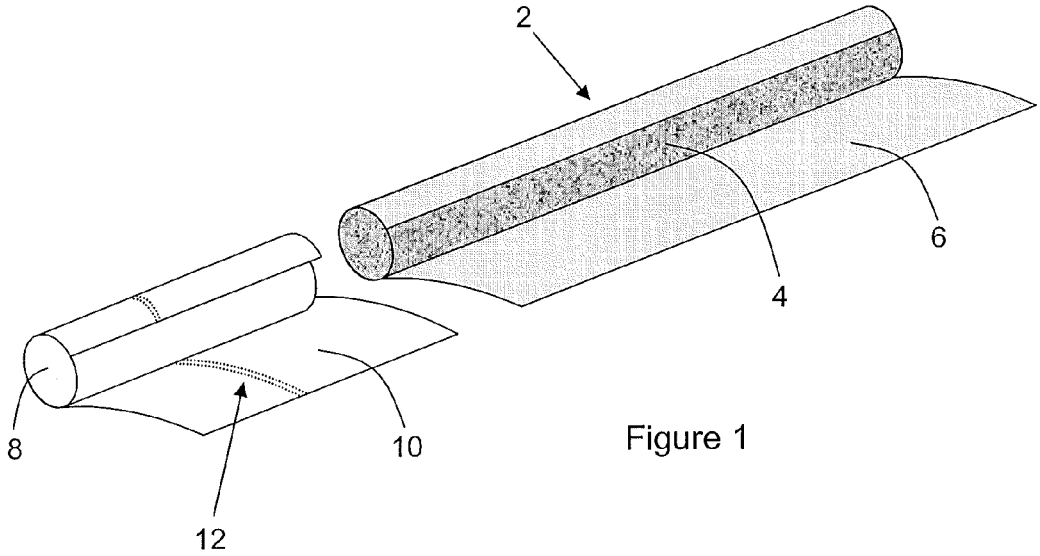
FIG. 1 shows a schematic perspective view of the tobacco cut filler, inner binder, filter and band of tipping paper of a cigarillo according to an embodiment of the invention during assembly thereof.

A cigarillo includes a tobacco rod including a tobacco cut filler circumscribed by an inner binder, a filter adjacent to the tobacco rod, a band of tipping paper circumscribing the filter, and an outer wrapper of natural tobacco circumscribing the tobacco rod and a rod end portion of the band of tipping paper such that a mouth end portion of the band of tipping paper is visible.

The inclusion of a visible length of tipping paper advantageously reduces the size of the outer wrapper of cigarillos compared to known cigarillos of the same dimensions that are over rolled with an outer wrapper of tobacco leaf along their entire length.

Tobacco leaves are relatively expensive, and so it is desirable when using tobacco leaves as outer wrappers for cigarillos and other smoking articles to utilize the limited area of the leaves effectively, to yield as many outer wrappers as possible. Typically, the entire area of a tobacco leaf is not suitable for use as an outer wrapper due to the presence of, for example, holes, fissures, cracks or regions of prominent venation. As the size of the outer wrapper required is smaller, natural tobacco outer wrappers for cigarillos may advantageously be made from areas of tobacco leaves that would be too small to be used as outer wrappers for known filter cigarillos of the same dimensions.

The visible length of tipping paper also advantageously avoids any direct contact between a consumer's lips and the natural tobacco of the outer wrapper of cigarillos. Furthermore, the visible length of tipping paper at the mouth end of cigarillos may advantageously be printed with, for example, manufacturer or brand logos, trade marks, slogans or other consumer information or indicia.

As used herein, the term 'length' denotes the dimension in the longitudinal direction of the cigarillo. As used herein, the term 'downstream' is used to describe the relative positions of components of cigarillos in relation to the direction of tobacco smoke drawn through the cigarillos during use.

The term 'natural tobacco' is used herein as in the Council Directive 95/59/EC of Nov. 27, 1995. Particularly, natural tobacco denotes a section of a tobacco leaf. For example, the natural tobacco may be an elongate strip of tobacco leaf or a substantially rectangular portion of tobacco leaf. Alternatively, the outer wrapper may include two or more pieces of tobacco leaf. For example, the outer wrapper may include a plurality of tessellated, polygonal tobacco leaf portions as described in international patent application WO-A-2007/085967. The natural tobacco may be cigarette tobacco like Virginia, Burley, Oriental and Semi Oriental tobacco. The natural tobacco may be, for example air, sun or flue-cured.

Cigarillos may include any suitable tobacco cut filler. Preferably, the cigarillo includes a cigarette tobacco cut filler including types of tobacco such as Virginia, Burley, Oriental and Semi Oriental. The tobacco cut filler may include a blend of two or more different types of tobacco. For example, the tobacco cut filler may include a blend of two or more of the above-mentioned different types of tobacco, such as an American blend. Alternatively, the tobacco cut filler may include a single one of the above-mentioned types of tobacco.

The tobacco cut filler may include tobaccos that are, for example, air, sun or flue-cured. Alternatively or in addition, the tobacco cut filler may have undergone treatment to, for example, reduce tobacco-specific nitrosamines (TSNA).

Besides tobacco leaf, the tobacco cut filler may include other ingredients typically found in tobacco cut filler such as, for example, expanded tobacco, homogenized tobacco (for example reconstituted tobacco, cast tobacco or extruded tobacco), tobacco stem (for example expanded or improved stem), tobacco fines and combinations thereof. Flavors and casings including one or more humectants, flavorants, sugars or combinations thereof may also be applied to the tobacco cut filler in a known manner.

Preferably, the tobacco cut filler is cut with a cut width of between about 0.4 mm and about 2.0 mm, more preferably with a cut width of between about 0.5 mm and about 0.8 mm.

Preferably, the moisture content of the tobacco cut filler is between about 10 percent and about 17 percent by weight. More preferably, the moisture content of the tobacco cut filler is between about 12 percent and about 13 percent by weight. The moisture content is the percentage of oven volatiles in the tobacco. The tobacco is weighed, subjected to 103 degrees for 100 minutes and then weighed again. The difference in weight (weight loss) divided by the initial weight gives the percentage oven volatiles.

The inner binder may be formed from any suitable known material or materials. Suitable materials from which the inner binder may be formed include, but are not limited to, paper, homogenized tobacco material (for example reconstituted tobacco or cast tobacco), natural tobacco and combinations thereof.

Where the inner binder includes paper, the paper may be white or may be colored to, for example, match the color of the outer wrapper of the cigarillo. Preferably, the paper is non-porous or has a low porosity, and has a low burn rate.

To produce cigarillos, tobacco rods including tobacco cut filler circumscribed by an inner binder are advantageously manufactured on standard high-speed cigarette making machinery. The tobacco rods may then be combined with a filter and overwrapped with a natural tobacco outer wrapper in a separate process. Alternatively, the tobacco rods may be combined with a filter to create semi-finished cigarillos that are then overwrapped with natural tobacco in a separate process, leaving a visible mouth end portion of the tipping paper circumscribing the filter free of the outer wrapper.

Cigarillos may include filters including a single filter segment. Alternatively, cigarillos may include multi-component filters including two or more filter segments.

The one or more filter segments may include any suitable known filtration materials including, but not limited to, cellulose acetate, paper and combinations thereof. Preferably the filter includes at least one segment including fibrous filtration material, more preferably cellulosic filtration material, most preferably cellulose acetate tow.

In a preferred embodiment, the filter includes a plug of cellulose acetate tow wrapped in a high porosity plug wrap. For example, the filter may include a plug of cellulose acetate tow wrapped in a plug wrap having an air permeability of between about 3000 $cm^3/min \cdot cm^2$ and about 24000 $cm^3/min \cdot cm^2$ as measured in accordance with ISO 2965:1997.

Preferably, the resistance to draw (RTD) of the filter is between about 20 mm WG (water gauge) and about 260 mm WG, more preferably between about 20 mm WG and about 130 mm WG as measured in accordance with ISO 6565:2002. Where the filter includes a plug of cellulose acetate tow, the denier per filament and total denier of the tow may be selected in order to achieve a desired overall resistance to draw for the filter.

The filter may include one or more sorbents capable of removing at least one gas phase constituent from mainstream smoke drawn through the filter. Suitable sorbents include, but are not limited to, carbon, activated alumina, zeolites, molecular sieves, silica gel and combinations thereof.

Alternatively or in addition, the filter may include one or more flavorants. For example, the filter may include a plug of cellulose acetate tow impregnated with a liquid flavorant. The liquid flavorant may be applied directly into a stream of cellulose acetate tow during manufacture of the filter, either by spraying the liquid flavorant under pressure onto the tow or by injecting the liquid flavorant into the tow. In other embodiments, the plug of cellulose acetate tow may include one or more threads impregnated with liquid flavorant. In yet further embodiments, the filter may include one or more breakable capsules containing a liquid flavorant.

Alternatively or in addition, the filter may include a segment including tobacco or other plant material. The tobacco or other plant material may be included in a plug of cellulose acetate tow or in a space inside the filter.

Preferably, the filter has a length ranging from about 5 mm to about 30 mm, more preferably ranging from about 15 mm to about 30 mm.

Preferably, the tipping paper has a basis weight ranging from about 30 $g/m^2$ to about 45 $g/m^2$. Preferably, the tipping paper has an inherent air permeability of less than about 800 $cm^3/min \cdot cm^2$.

Preferably, the length of the visible mouth end portion of the band of tipping paper is greater than the length of the rod end portion of the band of tipping paper.

Preferably, the tipping paper circumscribes the filter and an adjacent portion of the tobacco rod. Preferably, the portion of the tobacco rod circumscribed by the band of tipping paper ranging from about 2 mm to about 12 mm in length.

Preferably, the rod end portion of the band of tipping paper circumscribed by the outer wrapper ranging from about 1 mm to about 12 mm in length, more preferably about 2 mm to about 6 mm in length.

Preferably, the visible mouth end portion of the band of tipping paper is at least about 15 mm in length, more preferably ranging from about 25 mm to about 30 mm in length.

Preferably, the outer wrapper and the inner binder are in combination substantially air impermeable. This advantageously results in cigarillos having low ignition propensity and being self-extinguishing (that is extinguishing when left for an extended period without being puffed by a consumer).

Preferably, cigarillos have a total burn rate of ranging from about 0 percent to about 15 percent. More preferably, cigarillos have a total burn rate ranging from about 0 percent to about 5 percent. Most preferably, cigarillos have a total burn rate of about 0 percent.

The total burn rate is used to measure the ignition propensity of finished smoking articles according to the American Society for Testing and Materials standard ASTM E 2187-02b test procedure. The test procedure involves lighting a smoking article in a holder such that it burns a certain distance. If the smoking article does not extinguish, it is placed onto a substrate made of 3, 10 or 15 layers of filter paper. If the coal reaches the filter, the result is referred to as total burn. The total burn rate gives the percentage of smoking articles that show total burn, that is smoking articles that do not extinguish in the holder or on the substrate out of a batch of 40 smoking articles. In the ignition propensity test procedure according to ASTM E 2187-02b employed herein the substrate includes 10 layers of filter paper.

Preferably, the moisture content of the outer wrapper initially ranges from about 20 percent to about 35 percent by weight. More preferably, the initial moisture content of the outer wrapper ranges from about 25 percent to about 27 percent by weight.

The outer wrapper may be spiraled helically around the tobacco rod and the rod end portion of the band of tipping paper in a known manner so that the outer wrapper has a generally helical seam. Alternatively, the outer wrapper may be wrapped around the tobacco rod and the rod end portion of the band of tipping paper so that the outer wrapper has a longitudinal seam substantially parallel to the longitudinal axis of the cigarillo.

To form a longitudinal seam, the outer wrapper may be wrapped around the tobacco rod and the rod end portion of the band of tipping paper so that the longitudinal edges thereof abut one another. However, the outer wrapper is preferably wrapped around the tobacco rod and the rod end portion of the band of tipping paper so that there is a small overlap between the longitudinal edges thereof, which forms the longitudinal seam. The area of overlap is smaller than that in a helical outer wrapper. Therefore, less natural tobacco is advantageously required to produce a cigarillo having an outer wrapper with a longitudinal seam than a cigarillo with the same dimensions having a helical outer wrapper.

Preferably, the cigarillo has a length ranging from about 70 mm to about 100 mm. More preferably, the cigarillo has a length ranging from about 74 mm to about 86 mm.

Preferably, the cigarillo has a diameter ranging from about 4 mm to about 9 mm, more preferably the cigarillo has a diameter ranging from about 7.5 mm to about 8.5 mm.

Preferably, the cigarillo further includes ventilation at a location along the filter in order to ventilate mainstream smoke drawn through the filter from the tobacco rod.

Preferably, the ventilation includes at least one circumferential row of perforations through the visible mouth-end portion of the tipping paper. More preferably the ventilation includes between one and four circumferential rows of perforations through the visible mouth-end portion of the tipping paper. Preferably, the at least one circumferential row of perforations is located at least 12 mm from the mouth end of the cigarillo. Where two or more rows of perforations are present, the rows of perforations preferably have a spacing ranging from about 0.5 mm to about 1.5 mm.

Suitable methods and apparatus for forming the at least one circumferential row of perforations are known. For example, the tipping paper may be mechanically or electrostatically pre-perforated prior to assembly of the cigarillo, or the partially or fully assembled cigarillo may be laser perforated in order to form the at least one circumferential row of perforations.

Preferably, cigarillos have a ventilation of between about 10 percent and about 45 percent as measured in accordance with ISO 9512:2002. However, the cigarillo may alternatively be unventilated.

Preferably, a marking is provided around the circumference of the cigarillo. More preferably, an annular marking is provided around the circumference of the cigarillo. A marking may be printed onto the circumference of the cigarillo. Alternatively, a separate ring made from, for example, paper, plastic or other suitable material may be placed around the circumference of the cigarillo. The separate ring may be adhered or otherwise affixed to the cigarillo using, for example, an adhesive. Alternatively, the separate ring may be a friction fit around the circumference of the cigarillo, such that the ring does not move substantially along the length of the cigarillo.

The marking may be an annular marking that extends around substantially the entire circumference of the cigarillo. Alternatively, where the marking is printed onto the cigarillo or affixed to the cigarillo, the marking may extend around only a fraction of the circumference of the cigarillo. The marking may include, for example, manufacturer or brand logos, trade marks, slogans or other consumer information or indicia.

The provision of a marking is particularly preferred where the cigarillo includes only a very short length of visible tipping paper at the mouth end thereof. In such embodiments, the marking may indicate the position of the rod end of the filter of the cigarillo, and so advantageously provide the consumer with an indication of when to stop smoking the cigarillo. The marking may partially cover the band of tipping paper, or may partially cover the outer wrapper, or both.

A method of making a cigarillo includes the steps of convoluting an inner binder around a tobacco cut filler to form a tobacco rod, axially aligning and abutting a filter with the tobacco rod, convoluting a band of tipping paper around the filter, and convoluting an outer wrapper of natural tobacco around the tobacco rod and a rod end portion of the band of tipping paper such that a mouth end portion of the tipping paper is visible.

Preferably, the method includes convoluting the band of tipping paper around the filter and an adjacent portion of the tobacco rod.

Figure 2:
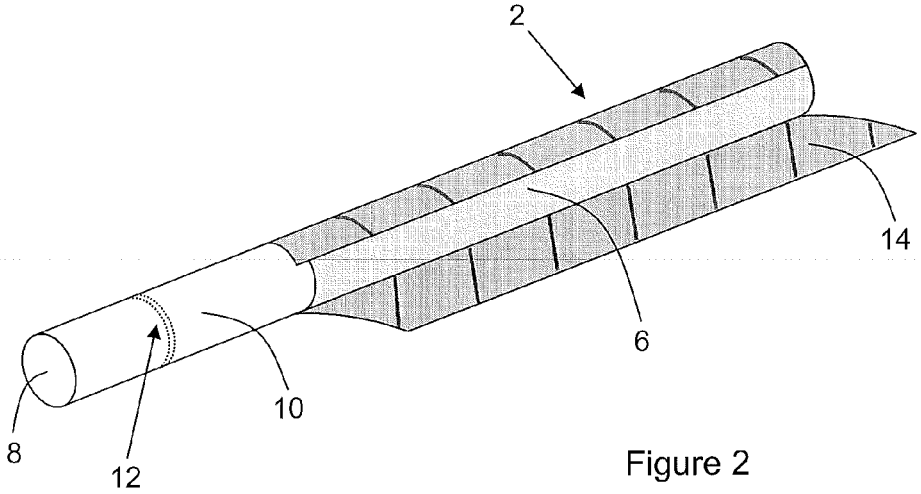
FIG. 2 shows a schematic perspective view of the tobacco rod, filter, band of tipping paper and outer wrapper of the cigarillo of FIG. 1 during assembly thereof.
Figure 3:
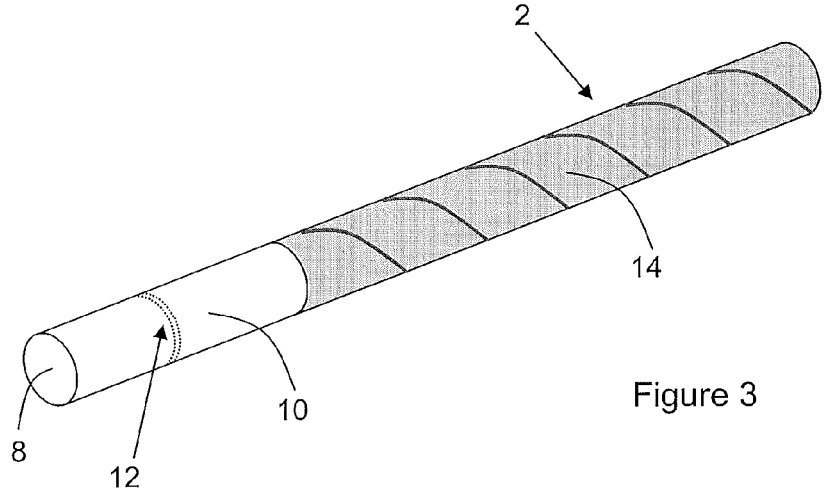
FIG. 3 shows the fully assembled cigarillo of FIGS. 1 and 2.

The cigarillo shown in FIGS. 1 to 3 includes an elongate cylindrical tobacco rod 2 including a tobacco cut filler 4 circumscribed by an inner binder 6 of homogenized tobacco. The tobacco rod 2 is formed by convoluting the inner binder 6 around a column of the tobacco cut filler 4 using suitable known machinery employed for the production of tobacco rods for filter cigarettes.

An elongate cylindrical filter 8 including a plug of cellulose acetate tow circumscribed by a high porosity plug wrap is axially aligned with the tobacco rod 2 at the downstream end thereof. The filter 8 and tobacco rod are attached to one another in abutting end-to-end relationship by a band of tipping paper 10, which circumscribes the filter 8 and an adjacent portion of the tobacco rod 2. As shown in FIGS. 1 to 3, two substantially parallel rows of perforations 12 are provided in the band of tipping paper 10 proximate the mouth end of the filter 8. The band of tipping paper 10 may be convoluted around and affixed to the filter 8 and adjacent portion of the tobacco rod 2 using suitable known machinery employed for attaching filters to tobacco rods during the production of filter cigarettes.

The cigarillo further includes an outer wrapper 14 consisting of a rectangular piece of air-cured tobacco leaf. As shown in FIG. 2, the outer wrapper 14 circumscribes the tobacco rod 2 and a rod end portion of the band of tipping paper 10 such that a mouth end portion of the band of tipping paper 10 is visible in the assembled cigarillo, as shown in FIG. 3. The outer wrapper 14 is convoluted around the tobacco rod 2 and rod end portion of the band of tipping paper 10 so that the longitudinal edges of the outer wrapper 12 overlap one another by a small amount to form a longitudinal seam (not shown) substantially parallel to the longitudinal axes of the tobacco rod 2 and filter 8.

The outer wrapper may be convoluted around and affixed to the tobacco rod 2 and the rod end portion of the adjacent portion of the tobacco rod 2 using suitable machinery employed in the production of cigarettes and cigarillos or by hand.

A cigarillo according to the embodiment of the invention shown in FIGS. 1 to 3 having the dimensions and properties given in Table 1 below is produced using conventional processes and apparatus employed in the production of filter cigarettes and cigarillos.

TABLE 1

| Cigarillo | |
|---|---|
| Overall length (mm) | 84 |
| Overall circumference (mm) | 25.60 |
| Overall resistance to draw | 115 |
| **Tobacco Rod** | |
| Length (mm) | 59 |
| Circumference (mm) | 24.65 |
| Weight of tobacco cut filler | 650 |
| Resistance to draw (mm WG) | 100 |
| **Filter** | |
| Length (mm) | 25 |
| Circumference (mm) | 24.45 |
| Plug wrap porosity | 4800 |
| Resistance to draw (mm WG) | 20 |
| **Band of Tipping Paper** | |
| Overall length (mm) | 29 |
| Length of visible mouth end | 27 |
| Ventilation (percent) | 15 |
| **Outer Wrapper** | |
| Length (mm) | 57 |
| Total burn rate (percent) | 0 |

The invention has been exemplified above with reference to a cigarillo including an outer wrapper with a longitudinal seam substantially parallel to the longitudinal axis of the cigarillo. However, it will be appreciated that cigarillos may include outer wrappers with helical seams.

In addition, while the invention has been exemplified above with reference to a cigarillo with a filter including a plug of cellulose acetate tow, it will be appreciated that cigarillos may include filters having other filtration materials. It will also be appreciated that cigarillos may include multi-component filters including two or more filter segments.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred filter cigarillo and methods of making the cigarillo with reference to a specific embodiment thereof, it will be apparent to one skilled in the art that various changes and modifications may be made to the cigarillo and equivalent methods may be employed, which do not materially depart from the spirit and scope of the foregoing description. Accordingly, all such changes, modifications, and equivalents that fall within the spirit and scope of the appended claims are intended to be encompassed thereby.

We claim:

1. A cigarillo comprising:

a tobacco rod having cut filler tobacco;

a tobacco inner binder circumscribing the cut filler tobacco, the tobacco inner binder consisting essentially of a first section of a tobacco leaf;

a filter adjacent to the tobacco rod;

a band of tipping paper circumscribing the filter, having a rod end portion and a mouth end portion; and a tobacco outer wrapper consisting essentially of a second section of a tobacco leaf circumscribing the tobacco rod and the rod end portion of the band of tipping paper such that the mouth end portion of the band of tipping paper is visible, the tobacco outer wrapper including a longitudinal seam substantially parallel to a longitudinal axis of the cigarillo and including a plurality of spaced-apart linear portions such that the linear portions form a helical pattern about the tobacco rod without discontinuity, wherein the combination of the tobacco outer wrapper and the tobacco inner binder is substantially air impermeable such that the cigarillo is self-extinguishing when left unattended on a substrate.

2. The cigarillo of claim 1, wherein a visible length of the mouth end portion of the band of tipping paper is greater than the length of the rod end portion of the band of tipping paper.

3. The cigarillo of claim 1, wherein the band of tipping paper circumscribes the filter and an adjacent portion of the tobacco rod.

4. The cigarillo of claim 3, wherein the portion of the tobacco rod circumscribed by the band of tipping paper ranges from about 2 mm to about 12 mm in length.

5. The cigarillo of claim 1, wherein the rod end portion of the band of tipping paper circumscribed by the tobacco outer wrapper is at least about 2 mm in length.

6. The cigarillo of claim 2, wherein the visible mouth end portion of the band of tipping paper is at least about 15 mm in length.

7. The cigarillo of claim 1, wherein the cut filler tobacco is cut with a cut width ranging from about 0.4 mm to about 2.0 mm.

8. The cigarillo of claim 1, wherein the cut filler tobacco has a moisture content of about 12.5%.

9. The cigarillo of claim 1, wherein the cigarillo has a total burn rate of about 0 percent to about 15 percent.

10. The cigarillo of claim 1, having a length ranging from about 70 mm to about 100 mm and a diameter ranging from about 7.5 mm to about 8.5 mm.

* * * * *